US005890969A

United States Patent [19]

Bechler

[11] Patent Number: 5,890,969

[45] Date of Patent: Apr. 6, 1999

[54] GOLF CLUB FOR PUTTING

[76] Inventor: Jurgen Bechler, Dachauer Str.140e, 80637 Munich, Germany

[21] Appl. No.: 922,355

[22] Filed: Sep. 3, 1997

[30] Foreign Application Priority Data

Sep. 5, 1996 [DE] Germany ..... 296 16 502.0

[51] Int. Cl.[6] ..... A63B 53/04

[52] U.S. Cl. ..... 473/255; 473/340; 473/341

[58] Field of Search ..... 473/251, 255, 473/340, 341, 349, 350, 345, 347, 348, 313, 314, 312

[56] References Cited

U.S. PATENT DOCUMENTS

| | | | |
|---|---|---|---|
| 3,219,348 | 11/1965 | Dishner, Jr. . | |
| 4,067,573 | 1/1978 | Key, Jr. . | |
| 4,426,083 | 1/1984 | Dishner, Jr. . | |
| 4,506,888 | 3/1985 | Nardozzi, Jr. | 473/313 X |
| 4,871,174 | 10/1989 | Kobayashi | 473/313 X |
| 5,046,740 | 9/1991 | D'Eath | 473/338 X |
| 5,494,282 | 2/1996 | Pranio | 473/314 X |
| 5,685,784 | 11/1997 | Butler | 473/313 X |
| 5,716,290 | 2/1998 | Baker et al. | 473/313 |

FOREIGN PATENT DOCUMENTS 295210052 8/1996 Germany .

*Primary Examiner*—Kien T. Nguyen
*Attorney, Agent, or Firm*—Dennison, Meserole, Pollack & Scheiner

[57] ABSTRACT

A golf club, in particular for putting, with a club shaft, a club grip and a putting slide, wherein the putting slide (4) consists of a base body (5), which in a view from above, is embodied to be T-shaped and has a transverse leg (6), a putting face (S) and a longitudinal leg (7) having a metal core (8) with a shaft base (9) for the club shaft (2) which is fastened in the longitudinal leg (7), and wherein the upper area (10) of the shaft base (9) and the club shaft (2) with the club grip (3) are at an angle (α) of between 10° and 20° in relation to a vertical plane.

20 Claims, 1 Drawing Sheet

Fig. 1
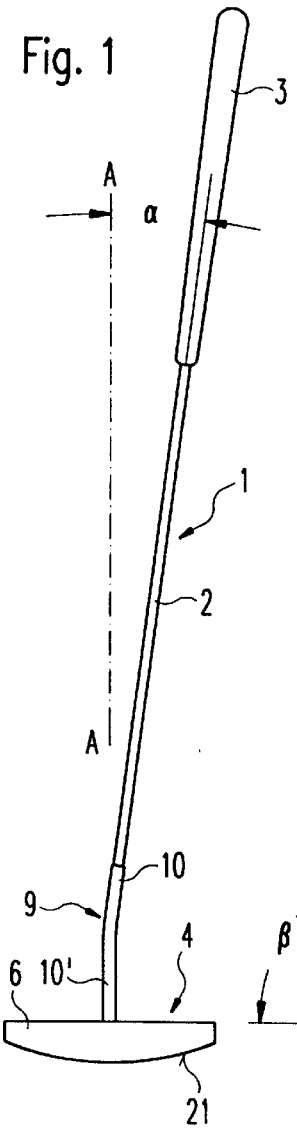
Fig. 2
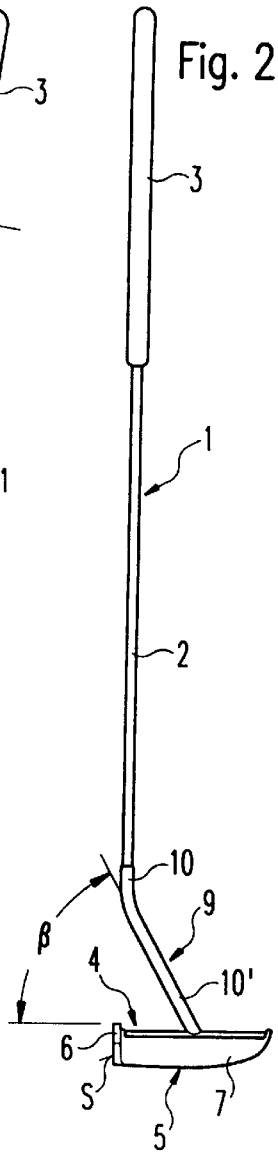
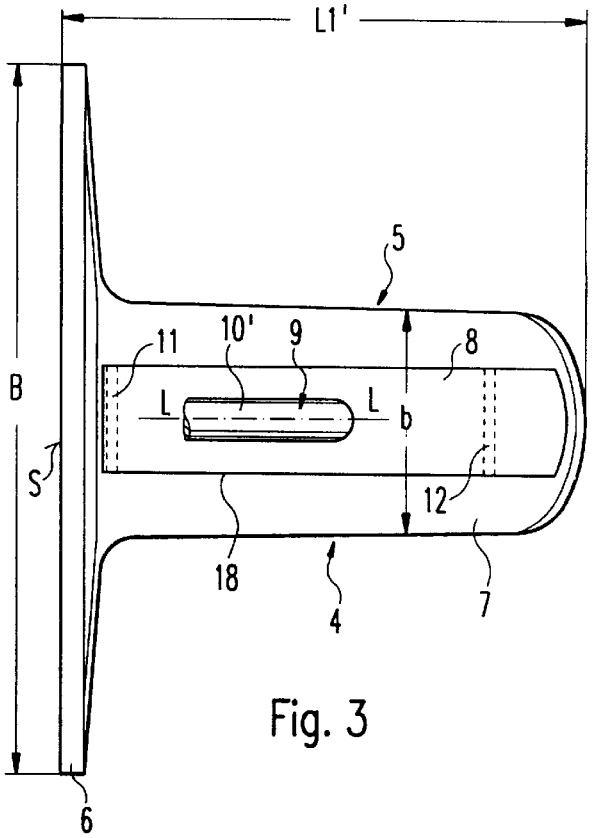
Fig. 3
Fig. 4
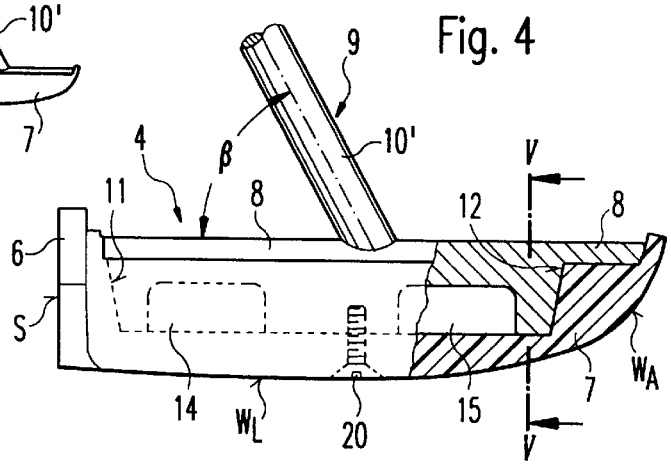
Fig. 5
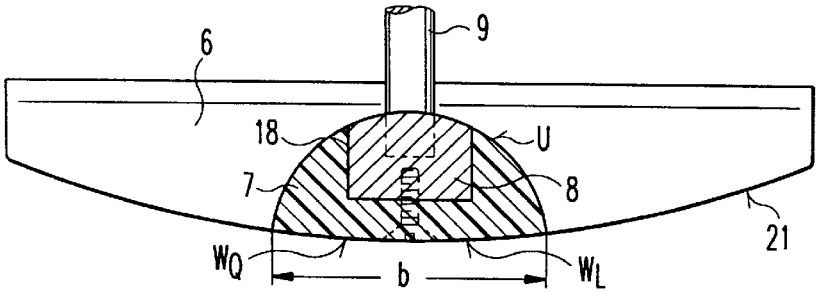

GOLF CLUB FOR PUTTING

The invention relates to a golf club, in particular for putting, with a club shaft with a club grip and a putting slide.

A large number of such golf clubs are already known from the prior art. They are used for putting the golf ball on the green by means of a careful stroke. It is disadvantageous in connection with the known constructions that the accurate back-and-forth motion of the golf club is no longer exactly assured because of frequent looks toward the target, with subsequent concentration on the golf ball to be moved, and that this results in a considerable number of errors.

To avoid these disadvantages, it has already been attempted to design the club grip in a special way (U.S. Pat. No. 4,426,083, U.S. Pat. No. 3,219,348, U.S. Pat. No. 4,067,573). All these grips of golf clubs for putting are designed in such a way that, in spite of the special design, they do not assure an accurate back-and-forth movement in the course of moving the golf club and that therefore they can result in a considerable number of errors, particularly since approximately 50% of the plays are decided at the shorter distance.

A specially designed golf club (German Utility Model 295 21 005.2) is also a part of the prior art, which allows a novel design of the club grip in the form of a fountain pen grip. The sensitivity in sighting is considerably improved by this and after briefly looking at the target, the golfer can completely concentrate on the back-and-forth movement, which results in a correct stroke.

Based on the prior art mentioned at the outset, it is the object of the instant invention to improve a golf club, in particular for putting, in such a way that further sighting accuracy is assured.

This object is attained in accordance with the invention in that the putting slide consists of a base body, which in a view from above is embodied to be T-shaped and has a transverse leg with a putting face and a longitudinal leg, that a metal core with a shaft base for the club shaft is fastened in the longitudinal leg, and that the upper area of the shaft base and the club shaft with the club grip are at an angle of between 10° and 20° in relation to a vertical plane. This special design results in a golf club which disengages considerably more elastically and has a reduced start velocity.

The back-and-forth behavior of the putter can be more easily sensed because of the steeper shaft, and there is the possibility of gripping this golf club in accordance with the invention in the manner of a fountain pen grip.

By means of this the sensitivity during sighting is considerably improved in an advantageous manner and, after a brief look at the target, the golfer can fully concentrate on the back-and-forth movement, with the result of executing a correct stroke.

In a further embodiment of the invention it is possible for the putting face of the transverse leg to be wider than the length of the longitudinal leg. The base surface of the longitudinal leg is furthermore embodied curved in the longitudinal and transversal plane. The loft of the putting face is advantageously positively affected by this, and the club shaft can be gripped more steeply in an inclined form and with improved holding.

In a further embodiment of the invention, at the end of the longitudinal leg the curve in the longitudinal plane makes a transition into a curved termination area, which essentially extends as far as the top of the base body. Improved guidance and the prevention of a hang-up of the putter during the return movement result from this termination area.

In accordance with another feature of the invention, the longitudinal leg can have an upper circular surface, circumferential in cross section, which is followed on the underside by the two curves. This circumferential surface can be provided with a rectangular recess for receiving the metal core. This recess can have wedge surfaces on the front and back, which correspond to the lateral walls of the metal core. A good material contact of the metal body in the recess of the longitudinal leg results from the cooperation between the recess with the wedge surfaces.

In its interior the metal core can have at least one chamber for receiving weights. An improved distribution of the center of gravity is assured by the insertion of weights. Furthermore, an increased damping component is provided. The weight of the putter can be changed, for example between approximately 250 and 350 g.

In accordance with another feature of the invention, the metal core can be made of one piece with the sleeve-shaped shaft base. The metal core can furthermore be glued or screwed into the recess of the longitudinal leg.

Because of the damping component, the base body and the metal core must consist of two different materials, for example, the base body can be made of plastic or wood, and the metal core with the shaft base of brass.

The invention will be described in more detail below by means of an exemplary embodiment represented in the drawings. Shown in the drawings are:

FIG. 1, a front view of the golf club in accordance with the invention,

FIG. 2, a lateral view of the golf club in accordance with the invention,

FIG. 3, a top view of the putting slide,

FIG. 4, an enlarged lateral view of the putting slide, and

FIG. 5, a section along the line V—V in FIG. 4.

A golf club 1, which in particular is used for putting, is represented in a front and a lateral view in FIGS. 1 and 2. This golf club 1 essentially consists of a club shaft 2 with a club grip 3 and a putting slide 4.

As can be seen from FIG. 3 in particular, the putting slide 4 consists of a base body 5, embodied T-shaped in a top view, with a transverse leg 6 with the putting face S, and with a longitudinal leg 7. A metal core 8 with the shaft base 9 for the club shaft is fastened in the longitudinal leg 7.

It can be seen in FIG. 1 that the upper area 10 of the shaft base 9 and the club shaft 2 with the club grip 3 are placed at an angle $\alpha$ in a range between 10° and 20° in respect to a vertical plane A—A.

In accordance with FIG. 3, the putting face S of the transverse leg 6 is wider than the length of the longitudinal leg 7. For example, the width B of the putting face S is approximately 200 mm, while the length L of the putting slide 4 is approximately 100 mm. The width b of the longitudinal leg can be approximately 40 to 45 mm.

As can be seen from FIGS. 4 and 5 in particular, the base surface of the longitudinal leg 7 in the longitudinal and transverse plane is respectively embodied as curves $W_L$, $W_Q$. In this case the curve $W_L$ makes a transition in the longitudinal plane at the end of the longitudinal leg 7 of FIG. 4 into a curved termination area $W_A$, which essentially extends as far as the top of the base body 5.

In accordance with FIG. 5, the longitudinal leg 7 has an upper, in cross section circular, circumferential surface U, which is followed on the underside by the two curves $W_L$, $W_Q$.

It can be seen from FIG. 5 in particular, that the circumferential surface U is provided with a recess 18, rectangular in cross section, which is used to receive the metal core 8.

In accordance with FIG. 4, the front and rear of the recess 18 can have wedge surfaces 11 and 12, which correspond to lateral walls of the metal core 8. The metal core 8 is drawn into the base body 5, for example by means of a screw 20 in accordance with FIG. 4, and into the recess 18, resting against the wedge surfaces 11, 12, and in this way is connected in a functionally secure manner with the longitudinal leg 7 of the putting slide 4.

It can be seen in FIG. 4 that in its interior the metal core 8 has two chambers 14 and 15 for receiving weights. It is possible by means of this to change the total weight of the putter after inserting the weights (not represented in detail), which in addition results in improved distribution of the center of gravity.

In accordance with FIGS. 1, 2 and 4, the metal core 8 constitutes a one-piece unit with the sleeve-shaped shaft base 9. The club shaft 2 is inserted into the sleeve-shaped shaft base and is fastened therein in a functionally secure manner.

In accordance with FIGS. 4 and 5, the metal core 8 is fastened by means of at least one screw 20 inside the recess 18 of the longitudinal leg. There is an alternative option, not shown in more detail, wherein the metal core 8 is connected with the longitudinal leg 7 inside the recess 18 by gluing.

In accordance with FIGS. 4 and 5, the putting face S is provided with a curve 21 on the underside.

It is important for a clean putt that the golfer be exactly aligned, i.e. that the putting slide 4 is aligned with the sighting line. To this end, in accordance with FIGS. 2, 3 and 4 the lower area 10' of the shaft base 9 is placed at angle β in respect to the horizontal plane, namely parallel with the longitudinal axis L—L of the longitudinal leg 7. This angle β is approximately 40° to 50°, preferably 45°. With an exact alignment a situation in accordance with FIG. 3 results, wherein the outer contours of the lower area 10' of the shaft base 9, those of the metal core 8 and those of the putting slide 9 appear to extend exactly parallel for the player, who defines the sighting line. By means of this it is assured that the back-and-forth moving body, i.e. the putting slide, is located on the sighting line.

The base body 5 and the metal core 8 can be made of two different materials. For example, the base body 5 can be made of plastic, and the metal core 8 with the shaft base 9 of brass.

An improved distribution of the center of gravity and an improvement in the damping component result from the completely novel design of the golf club, in particular for putting, because of the special design of the putting slide 4 and the angled club shaft 2. The putter disengages considerably more elastically, so that a reduced start velocity is required.

I claim:

1. A golf club for putting comprising a club shaft (2) with a club grip (3) and a putting slide (4), wherein the putting slide consists of a base body (5), which in a view from above is embodied to be T-shaped and has a transverse leg (6) with a putting face (S) and a longitudinal leg (7), said longitudinal leg has an upper side surface (U), circumferential in cross section, which is followed by two curves ($W_L$, $W_Q$) on an underside surface; a metal core (8) with a shaft base (9) for the club for the club shaft (2) which is fastened in the longitudinal leg (7), and the upper area (10) of the shaft base (9) and the club shaft (2) with the club grip (3) are at an angle (α) of between 10° and 20° in relation to a vertical plane (A—A).

2. The golf club in accordance with claim 1, the putting face (S) of the transverse leg (6) is wider than the length of the longitudinal leg (7).

3. The golf club in accordance with claim 1, wherein the underside surface of the longitudinal leg is embodied as a curve ($W_L$, $W_Q$) in the longitudinal and transversal plane.

4. The golf club in accordance with claim 3, wherein at the end of the longitudinal leg the curve ($W_L$) in the longitudinal plane makes a transition into a curved termination area ($W_A$), which essentially extends as far as the top of the base body (5).

5. The golf club in accordance with claim 1 wherein the circumferential surface (U) is provided with a recess (18), rectangular in cross section, for receiving the metal core (8).

6. The golf club in accordance with claim 5, wherein the front and rear of the recess (18) has partial surfaces (11, 12), which correspond to the lateral walls of the metal core (8).

7. The golf club in accordance with claim 1, wherein the metal core (8) is embodied in one piece with the sleeve-shaped shaft base (9).

8. The golf club in accordance with claim 1, wherein the metal core (8) is glued or screwed inside the recess (18) of the longitudinal leg (7).

9. The golf club in accordance with claim 1, wherein the length (L) of the putting slide (4) is approximately 100 mm, the width (B) of the putting face (S) is approximately 130 mm, and the width (b) of the longitudinal leg (7) of the T-shaped base body (5) is approximately 40 to 45 mm.

10. The golf club in accordance with claim 1, wherein the putting face (S) is curved on the underside.

11. The golf club in accordance with claim 1, wherein a lower area (10') of the shaft base (9) is parallel with a longitudinal axis (L—L) of the longitudinal leg (7) and is angled at an angle (β) in respect to the horizontal plane.

12. The golf club in accordance with claim 1 the base body (5) and the metal core (8) are made of two different materials.

13. The golf club in accordance with claim 1, wherein the base body (5) is made of plastic and the metal core (8) with the shaft base (9) is made of brass.

14. The golf club in accordance with claim 1, wherein the circumferential surface (U) is provided with a recess (18), rectangular in cross section, for receiving the metal core (8).

15. The golf club in accordance with claim 14, wherein the front and rear of the recess (18) has wedge surfaces (11, 12) which correspond to the lateral walls of the metal core (8).

16. The golf club of claim 1, wherein at least one chamber (14, 15) is provided in the interior of the metal core (8) for receiving weights.

17. A golf club for putting comprising a club shaft (2) with a club grip (3) and a putting slide, wherein the putting slide consists of a base body (5), which in a view from above is embodied to be T-shaped and has a transverse leg (6) with a putting face (S) and a longitudinal leg (7), a metal core (8) with a shaft base (9) for the club shaft (2) fastened in the longitudinal leg (7); an upper area (10) of the shaft base (9) and the club shaft (2) with the club grip (3) are at an angle (α) of between 10° and 20° in relation to a vertical plane (A—A); and the interior of the metal core (8) includes at least one chamber (14, 15) for receiving weights.

18. A golf club for putting comprising a club shaft with a club grip and a putting slide, wherein the putting slide (4) consists of a base body (5), which in a view from above is embodied to be T-shaped and has a transverse leg (6) with a putting face (S) and a longitudinal leg (7), a metal core (8) with a shaft base (9) for the club shaft (2) is fastened in the longitudinal leg (7), and the upper area (10) of the shaft base (9) and the club shaft (2) with the club grip (3) are at an angle ($\alpha$) of between 10° and 20° in relation to a vertical plane (A—A), at the end of the longitudinal leg a curve ($W_L$) in the longitudinal plane makes a transition into a curved termination area ($W_A$), which extends as far as the top of the base body (5), and the lower area (10') of the shaft base (9) is parallel with the longitudinal axis (L—L) of the longitudinal leg (7) which is angled at an angle ($\beta$) in respect to the horizontal plane.

19. The golf club in accordance with claim 14, wherein the angle ($\beta$) is between 40° and 50°.

20. The golf club in accordance with claim 18, wherein the angle ($\beta$) is in the range of 40° and 50°.

* * * * *